United States Patent [19]

Hutchison et al.

[11] 4,187,911

[45] Feb. 12, 1980

[54] SLANT HOLE FOAM CLEANOUT

[75] Inventors: Stanley O. Hutchison, Bakersfield; Glenn W. Anderson, Oildale, both of Calif.

[73] Assignee: Chevron Research Company, San Francisco, Calif.

[21] Appl. No.: 891,417

[22] Filed: Mar. 29, 1978

[51] Int. Cl.[2] ..... E21B 21/00

[52] U.S. Cl. ..... 166/312; 175/69; 166/241

[58] Field of Search ..... 166/241, 309, 311, 312; 175/61, 69, 325

[56] References Cited

U.S. PATENT DOCUMENTS

| | | | |
|---|---|---|---|
| 3,042,125 | 7/1962 | Duncan | 175/61 X |
| 3,463,231 | 8/1969 | Hutchison et al. | 166/312 X |
| 3,526,280 | 9/1970 | Aulick | 166/241 X |
| 3,583,489 | 6/1971 | Hutchison et al. | 166/312 |
| 3,662,828 | 5/1972 | Hutchison | 166/312 |

*Primary Examiner*—Ernest R. Purser
*Assistant Examiner*—Nick A. Nichols, Jr.
*Attorney, Agent, or Firm*—R. L. Freeland, Jr.; G. W. Wasson

[57] ABSTRACT

A method for removing material from directional wells using centralized tubing to circulate foam in the well at a velocity in excess of 30 feet per minute.

5 Claims, 3 Drawing Figures

SLANT HOLE FOAM CLEANOUT

BACKGROUND OF THE INVENTION

In the production of hydrocarbons from producing formations, it has become common to drill directional wells from the earth's surface to an underground producing formation. Directional drilling usually involves diverting a well from the vertical at some place below the earth's surface to direct it to a remote producing formation. The directional or slanted wells may deviate up to 90° from the vertical to reach a desired producing formation.

The directional wells are completed for the production of hydrocarbons using suitable casing strings and production liners. It is often desirable to remove or "clean out" material from directional wells during completion, recompletion or service operations on the wells. Heretofore, as noted in U.S. Pat. No. 3,463,231, a gas-liquid foam has been used to clean out wells. Foam cleanout has been done in directional wells. However, in wells having more than 15° deviation and especially more than 30° deviation from the vertical, it has been found that special techniques greatly improve the removal of material. The present invention is directed to improving foam clean out in such directional wells.

BRIEF DESCRIPTION OF THE INVENTION

The present invention provides for removing material such as sand from a directional well which deviates more than about 15° from the vertical over a substantial portion of its depth. A string of clean-out tubing is run into the directional well from the earth's surface to the position in the well where foam is desired. The tubing string is provided with centralizers to insure that the tubing string is in substantially coaxial alignment with the existing conduits in the well such as the casing string and the production liner or the production tubing if the clean out is being done through production tubing. A gas and liquid foam having a gas-to-liquid ratio of at least 10 SCF/m per gallon and not more than 30 SCF/m per gallon is generated at the surface and injected down the well and circulated through the well at a circulation rate of at least 30 feet per minute to remove material from the well.

OBJECTS OF THE INVENTION

The principal object of the present invention is to provide a method for cleaning out a directional well using foam circulated through a centralized tubing string positioned within the well conduits. Additional objects and advantages of the present invention will become apparent from the following detailed description read in light of the accompanying drawings which are made a part of this specification.

DETAILED DESCRIPTION OF THE INVENTION

Figures 1, 2:
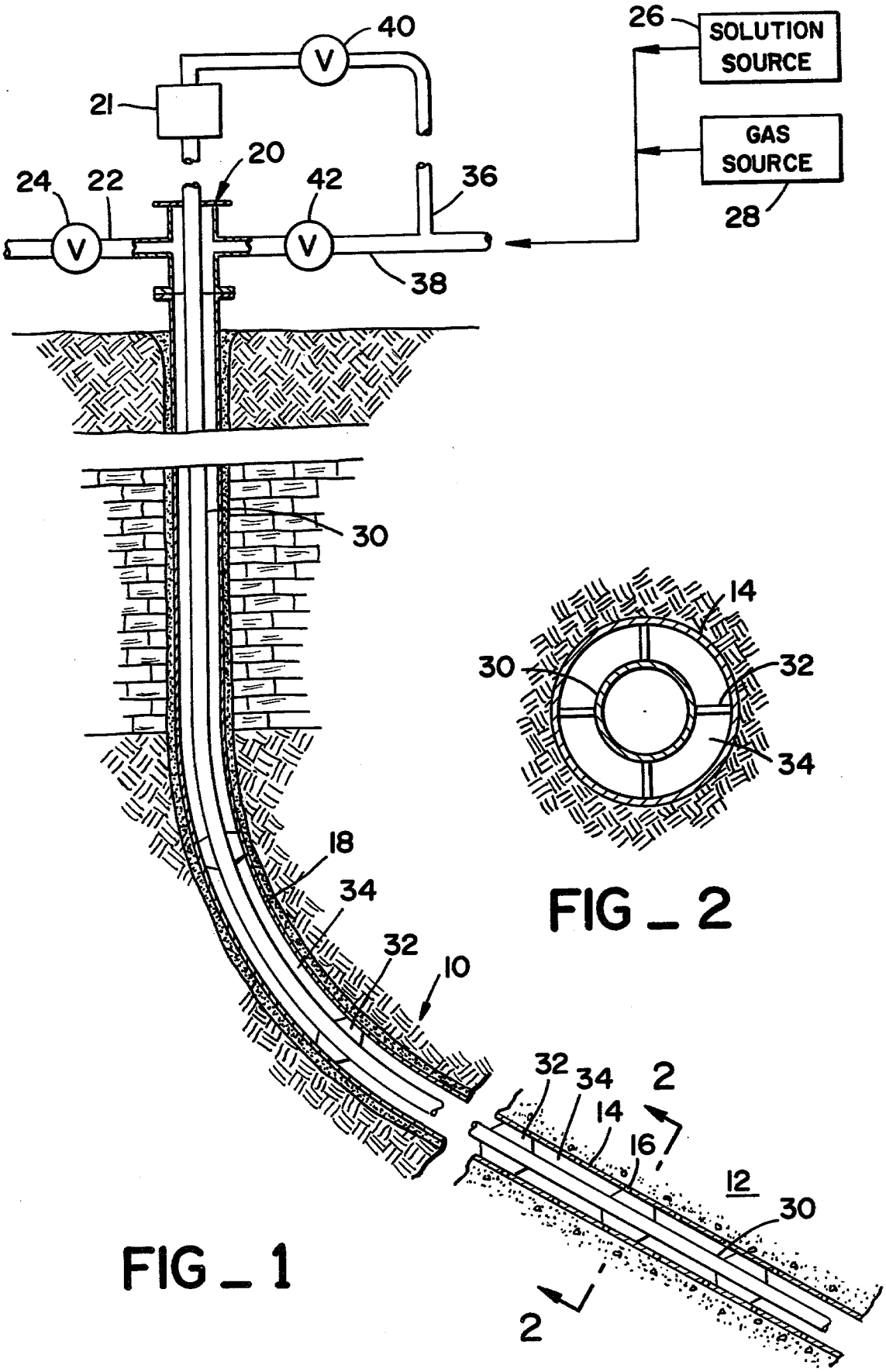
FIG. 1 is an elevational view, partially in section, and illustrates apparatus assembled in accordance with the present invention located in a directional well.
FIG. 2 is an enlarged sectional view taken at line 2—2 of FIG. 1.

With reference to the drawings and to FIGS. 1 and 2 in particular, a directional well is indicated by the numeral 10. The well 10 extends from the earth's surface to penetrate a producing formation 12. A well liner 14 having slots 16 is positioned adjacent the producing formation 12. The slots provide communication between the interior of the well 10 and the producing formation 12. The oil produced through the slots is often accompanied by sand which may periodically need to be removed from the well.

The upper portion of the well 10 is lined with a casing string 18 which may be cemented in place. A wellhead, indicated generally as 20, closes off the upper portion of the casing and provides for connecting various flow lines to the well. Thus, an exit conduit 22 having a valve 24 is used to provide an opening from the well.

A clean-out tubing string 30 is run into the well. The tubing string 30 is centralized in the interior of the well by means of a plurality of centralizers 32. The tubing string 30 is centralized in coaxial alignment within the well conduits, in this case, liner 14 and casing string 18. In this manner the tubing string 30 provides an inner passage from the surface to its lower end and an annular passage 34 between its outer surface and the well conduits 14 and 18 from the surface to its lower end.

A solution source 26 and a gas source 28 are connected by suitable conduits 36, 38 and valves 40, 42, respectively, to the interior of the tubing string 30 and the tubing-casing annulus 34 through the wellhead 20. Means are provided as schematically illustrated by number 21 for raising and lowering the tubing string. The solution source and gas source are sized to provide a foam for circulation in the well at a rate of at least 30 feet per minute with a ratio of gas to liquid of at least 10 SCF/m per gallon of solution. Suitable foam compositions are described in U.S. Pat. No. 3,463,231, the contents of which are hereby incorporated by reference.

Heretofore the clean-out tubing was not centralized when cleaning directional wells. However, it has been found that, when directional wells exceed 15° deviation from the vertical, efficient clean out is not obtained when the clean-out string is not centralized. When the clean-out tubing string is not centralized, the sand in the well is moved only one layer at a time, producing movement similar to the movement of a sand dune. This "sand dune effect" is particularly noticeable in wells deviated more than 30° from the vertical. Centralizing the clean-out string greatly reduces the sand dune effect and permits efficient removal of sand when foam is circulated through the well with a velocity of at least 30 feet per minute and the ratio of the gas to the liquid in the foam is maintained between 10 SCF/m per gallon and 30 SCF/m per gallon. Suitable centralizers for use in the present invention are shown and described in copending application Ser. No. 706,862, filed July 19, 1976, the disclosure of which is incorporated herein by reference.

Figure 3:
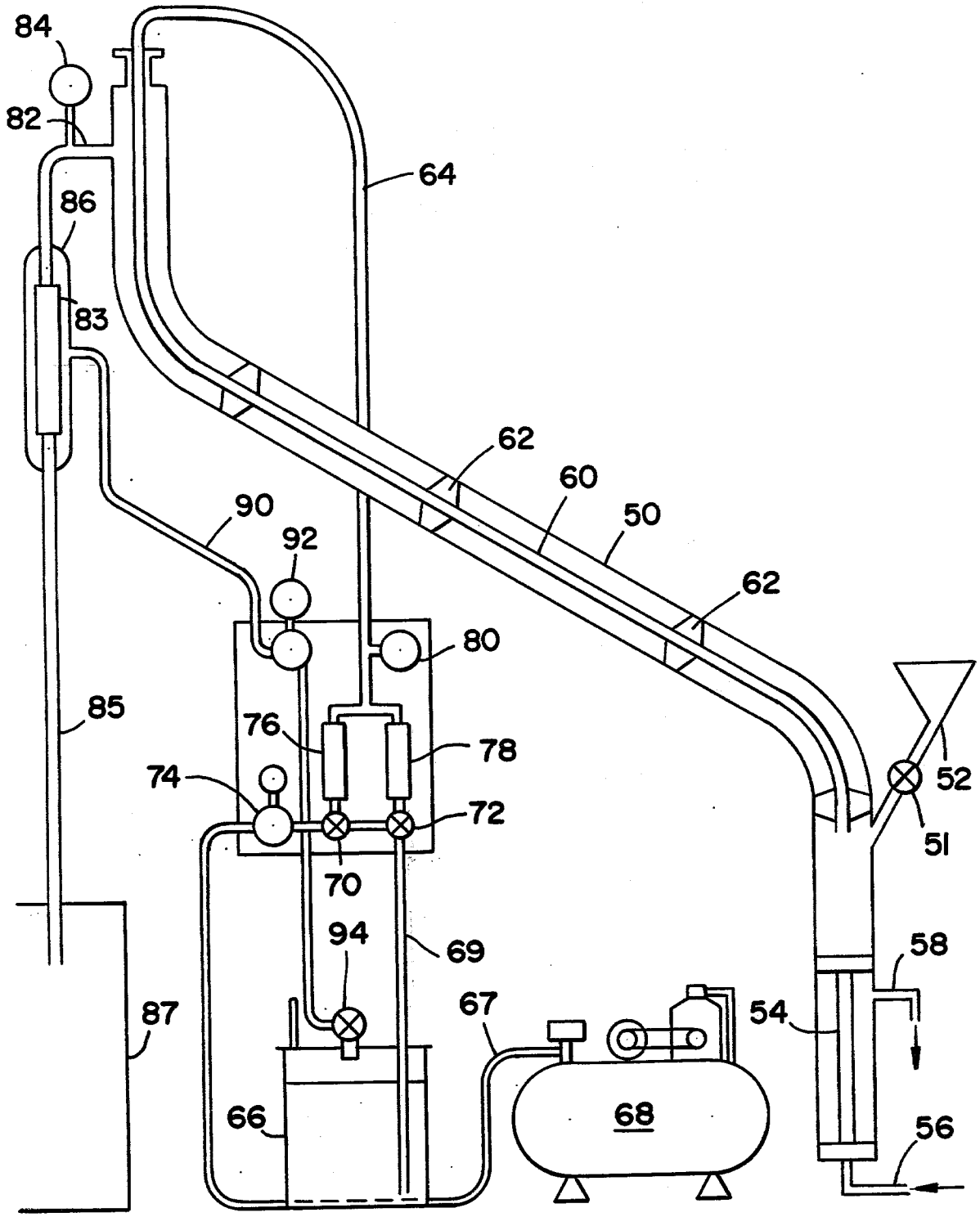
FIG. 3 is a schematic elevational view of test apparatus useful in the present invention.

FIG. 3 is a schematic elevational view of test apparatus used in discovering the desirable effect that centralizing the clean-out tubing string has on removing material from a slanted well. A 2"-OD, 1½"-ID lucite tube is used to represent a well conduit 50, such as a liner and casing string. The lower end of the conduit 50 is provided with a sand entry port and funnel 52. Flow through the funnel is controlled by valve 51. A hydraulic ram 54 having fluid ports 56 and 58 is used to move the sand within the conduit 50 to simulate operating conditions. A simulated clean-out tubing string 60 is formed within conduit 50 by a length of $\frac{5}{8}$"-OD copper tubing. The clean-out tubing 60 may be centralized as shown by the tubing centralizers 62. The tubing 60 may also be left uncentralized for comparative purposes.

The upper end of the conduit 50 is provided with connections to simulate those of a wellhead clean-out line 60. A pressurized (60 psi) foam solution source 66 and a gas source (120 psi) 68 are connected by conduits 67, 69, 64 through suitable valves 70, 72, inlet air regulator 74 and meters 76, 78 and 80 to clean-out tubing 60. The tubing 60-conduit 50 annulus is vented through a line 82 and pressure gauge 84. Line 82 is connected through a resilient sleeve 83 within tube 86 to line 85 which leads to a foam disposal buckle 87. The tube 86 sealing engages both tubes 82 and 85 and is provided with a connecting line 90, a pressure gauge 92 and a valve 94 so that the back pressure on the foam may be changed by pressurizing resilient sleeve 83.

When the equipment of FIG. 3 is used, it is possible to visually inspect the effect of foam clean out of a directional well under various conditions. It has been found that, when the well deviates more than 15° from the vertical and the tubing is not centralized, a sand dune effect occurs. This effect becomes particularly troublesome in wells where deviation exceeds 30° from the vertical. The sand dune effect can be substantially reduced in high-angle wells and eliminated in lower-angle wells by centralizing the clean-out tubing. Thus, numerous runs in the test apparatus using foam having a gas-to-liquid ratio of between 10 SCF/hr and 30 SCF/hr per gallon, which is the equivalent of field operations at 10 SCF/m and 30 SCF/m, and circulated at from 35 to 45 feet per minute showed that a sand load of 600 grams could be removed from a vertical well in 3 to 4 minutes. An uncentralized well deviated 60° from the vertical, however, required 25 to 26 minutes of circulation under the same conditions. However, when the tubing was centralized, the 600 grams of sand could be circulated out in 5–6 minutes under the same conditions from the 60° slanted well.

Thus, in summary, if well deviation is greater than 15° from the vertical, the clean-out tubing should be centralized for most effective cleaning. When deviation exceeds 30° from the vertical, the sand-duning effect becomes pronounced and it is especially important that the tubing be centralized and that the foam have a gas-to-liquid ratio between 10 SCF/m and 30 SCF/m per gallon of foam solution and that the foam circulation velocity exceed 30 feet per minute.

While preferred embodiments of the invention have been shown and described in detail, it is evident that modifications thereof can be made without departing from the spirit of the invention and such modifications are meant to be included within the appended claims.

What is claimed is:

1. A method of cleaning out a directional well, said well having more than about 15° deviation from the vertical over a substantial portion of its depth comprising running into a directional well having well conduits positioned therein a string of clean-out tubing of smaller outside diameter than the inside diameter of the well conduits, centralizing said clean-out tubing in coaxial alignment within said well conduits in said well to provide an inner passageway from the surface through the interior of said clean-out tubing and an annular passageway between the outside of said clean-out tubing and said well conduits in said well, injecting a gas and liquid foam having a gas-to-liquid ratio of between 10 SCF/m and 30 SCF/m per gallon down one of said passageways and continuing to inject said foam down said one of said passageways and up the other of said passageways at a circulation rate of at least 30 feet per minute to remove material from said well.

2. The method of claim 1 wherein the directional well has more than 30° deviation from the vertical.

3. The method of claim 1 wherein the gas-to-liquid ratio of said foam is maintained at about 20 SCF/m per gallon.

4. The method of claim 1 wherein the foam is injected down said inner passageway and circulated up said annular passageway.

5. The method of claim 1 wherein the foam is injected down said annular passageway and circulated up said inner passageway.

* * * * *